US011092377B2

(12) United States Patent
Peirsman et al.

(10) Patent No.: US 11,092,377 B2
(45) Date of Patent: Aug. 17, 2021

(54) DISPENSING APPARATUS PROVIDED WITH A COOLING UNIT

(71) Applicant: Anheuser-Busch InBev S.A., Brussels (BE)

(72) Inventors: Daniel Peirsman, Leuven (BE); Stijn Vandekerckhove, Leuven (BE)

(73) Assignee: Anheuser-Bush InBev S.A., Brussels (BE)

( * ) Notice: Subject to any disclaimer, the term of this patent is extended or adjusted under 35 U.S.C. 154(b) by 7 days.

(21) Appl. No.: 16/465,544

(22) PCT Filed: Nov. 29, 2017

(86) PCT No.: PCT/EP2017/080887
§ 371 (c)(1),
(2) Date: May 30, 2019

(87) PCT Pub. No.: WO2018/100013
PCT Pub. Date: Jun. 7, 2018

(65) Prior Publication Data

US 2020/0096246 A1 Mar. 26, 2020

(30) Foreign Application Priority Data

Nov. 30, 2016 (EP) ..... 16201336

(51) Int. Cl.
*F25D 19/00* (2006.01)
*B67D 1/00* (2006.01)
(Continued)

(52) U.S. Cl.
CPC ..... *F25D 19/006* (2013.01); *B67D 1/0061* (2013.01); *B67D 1/0861* (2013.01);
(Continued)

(58) Field of Classification Search
CPC ..... F25D 19/006; F25D 31/006; F25D 2331/802; F28F 5/00; F28F 2255/04;
(Continued)

(56) References Cited

U.S. PATENT DOCUMENTS 3,386,261 A 6/1968 Cornelius
2009/0038317 A1* 2/2009 Otey ..... F25B 21/04 62/3.2
2010/0127015 A1 5/2010 Boyer

FOREIGN PATENT DOCUMENTS

EP 0 250 003 12/1987
JP 2003-72897 3/2003
(Continued)

*Primary Examiner* — Emmanuel E Duke
(74) *Attorney, Agent, or Firm* — Levy & Grandinetti

(57) ABSTRACT

A beverage container cooling unit has: (a) a housing having a slot for receiving a container therein, (b) a cooling element having a cold supply, (c) a heat conductive panel enabling heat transfer between a container provided in the slot and the cold supply; wherein the heat conductive panel has two material layers fixed against one another: (I) a first material layer defining a cooling surface facing the container receiving slot and an opposed surface, said first layer made of a material having a thermal expansion coefficient of $X_1$; (ii) a second material layer having a contact surface facing positioned against the opposed surface of the first material layer and a second opposed surface, the second material layer having a thermal expansion coefficient of $X_2$, different from $X_1$, the difference in thermal expansion causing the conductive panel to bulge at a change in temperature.

16 Claims, 3 Drawing Sheets

(a)

(b)

(51) Int. Cl.
*B67D 1/08* (2006.01)
*F25D 31/00* (2006.01)
*F28F 5/00* (2006.01)

(52) U.S. Cl.
CPC ..... *B67D 1/0869* (2013.01); *F25D 31/006* (2013.01); *F28F 5/00* (2013.01); *B67D 2210/00104* (2013.01); *F25D 2331/802* (2013.01); *F28F 2255/02* (2013.01); *F28F 2255/04* (2013.01)

(58) Field of Classification Search
CPC . F28F 2255/02; B67D 1/0061; B67D 1/0861; B67D 1/0869; B67D 2210/00104
See application file for complete search history.

(56) References Cited

FOREIGN PATENT DOCUMENTS

| | | |
|---|---|---|
| JP | 2004-212029 | 7/2004 |
| JP | 2008-111920 | 5/2008 |

* cited by examiner (a)

(b)

DISPENSING APPARATUS PROVIDED WITH A COOLING UNIT

TECHNICAL FIELD

The present invention concerns a dispensing apparatus for domestic use or of the type found in pubs and bars for dispensing a liquid, typically a beverage such as a beer or other carbonated beverages which are to be served at a low temperature. In particular, the dispensing apparatus of the present invention is provided with a cooling cartridge which can be engaged into a cooling unit and thus form a section of a dispensing tube which is in thermal contact with cooling plates mounted in the cooling unit.

BACKGROUND OF THE INVENTION

Many applications require the cooling of a liquid. In particular, beverages or beverage components must often be cooled prior to or upon dispensing. This is the case for dispensing malt based beverages, such as beer, or any soda. There are basically two ways of serving a beverage at a temperature substantially lower than room temperature: either a whole container or reservoir containing the beverage or a component thereof to be dispensed is cooled, or only the volume of beverage or beverage component flowing through a dispensing tube from the container or reservoir to a tapping valve is cooled.

Cooling only the volume of beverage flowing through the dispensing tube is difficult to attain, because of the numerous challenges of such process. It must be taken into consideration that the dispensing tube must be cleaned or changed at regular intervals, either because the type of beverage (type of beer) changes from one container to the other, or because with time bacterial deposits may form in a dispensing tube. Another challenge is that beer must be dispensed at a relatively high flow rate, of typically 2 oz/s or 3.5 l/min, and it is difficult to extract all the thermal energy required to bring the temperature of the beverage to the desired value at such flow rates.

Many beverage dispensers comprise a cooled compartment for storing and cooling a container or reservoir. A common cooling system is based on the compression-expansion of a refrigerant gas of the type used in household refrigerators. Thermoelectric cooling systems using the Peltier effect have also been proposed in the art for cooling a container stored in a dispensing apparatus.

One challenge of cooling the whole container/reservoir is that when an empty container must be replaced by a new one or when a reservoir needs to be refilled, it takes considerable time to bring the content of the new container or refilled reservoir down to the desired low temperature. A solution to this problem is of course to constantly store a full container in a cooled compartment so that it can be used immediately after being loaded into a dispensing apparatus in replacement of an empty container. This solution, however, requires the investment of an additional cooling compartment for storing cooled containers in the wait of being loaded, and requires extra work to store a new container into the cooled compartment after having loaded a new cooled container onto the dispensing apparatus.

There therefore remains a need for a cooling system suitable for cooling beer stored in a container at high rates suitable for use in domestic appliances or in pubs and bars. The present invention proposes a solution to this need, with a user friendly system, requiring no skills to install and of easy maintenance. These and other advantages of the present invention are presented in continuation.

SUMMARY OF THE INVENTION

The present invention is defined in the appended independent claims. Preferred embodiments are defined in the dependent claims. In particular, the present invention concerns a cooling unit for a beverage dispensing apparatus, comprising:

(a) a housing comprising a slot for receiving a container therein;

(b) a cooling element comprising a cold supply;

(c) a heat conductive panel enabling heat transfer between a container provided in the slot and the cold supply;

characterized in that the heat conductive panel comprises two material layers fixed against one another:

(i) a first material layer defining a cooling surface facing the container receiving slot and an opposed surface, said first layer made of a material having a thermal expansion coefficient of $X_1$;

(ii) a second material layer having a contact surface facing positioned against the opposed surface of the first material layer and a second opposed surface, the second material layer having a thermal expansion coefficient of $X_2$, different from $X_1$, the difference in thermal expansion, causing the conductive panel to bulge at a change in temperature.

In order to increase the contact between the heat conductive panel and the container during cooling, it is preferred that $X_1>X_2$, such that upon cooling the heat conductive panel bulges to define a concave shape facing the slot for receiving the container.

The first material layer, defining the cooling surface is preferably manufactured in a material having a thermal expansion coefficient $X_1$ of $8\times10^{-6}$ $K^{-1}$ preferably $10\times10^{-6}$ $K^{-1}$ or more, such as aluminium, whereas the second material layer is preferably manufactured in a material having a thermal expansion coefficient $X_2$ of $6\times10^{-6}$ $K^{-1}$ preferably $4\times10^{-6}$ $K^{-1}$ or less, such as invar.

The heat conductive panel preferably comprises a socket in thermal conductive contact with the first material layer and enabled to contact the cold supply of the cooling element.

According to a preferred embodiment, a regulator is provided allowing varying the distance between the socket and the cold supply.

Additionally, it is preferred that the cooling unit comprises a pulse generator coupled with an output coupled to a motion producing means for cyclically producing a mechanical motion of a beverage container provided in the slot.

The present invention also concerns a beverage dispensing apparatus comprising a cooling unit according to the present invention.

The beverage dispensing apparatus preferably comprising a first container containing a concentrated beverage component and fluidly connected to a dispense tap by a first dispense line and a second container or reservoir containing a diluent and fluidly connected to the dispense tap by a second dispense line, the cooling unit integrated in the apparatus for cooling the concentrated beverage container and/or the container or reservoir containing the diluent.

Additionally, the dispensing apparatus may comprise a mixing unit having an inlet in fluid communication with the first and second dispense lines and an outlet in fluid communication with the dispense tap.

In a particular embodiment the dispensing apparatus may a carbonation unit, preferably an in-line carbonation unit, having an inlet in fluid communication with the second container or reservoir containing the diluent and an outlet in fluid communication with the dispense tap, the cooling unit integrated in the apparatus for cooling the diluent container.

The beverage dispensing apparatus can be either of a type suited as a domestic apparatus for dispensing a carbonated malt-based beverage, or of a type suited as a on-trade apparatus suitable for dispensing a carbonated malt-based beverage.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 2:
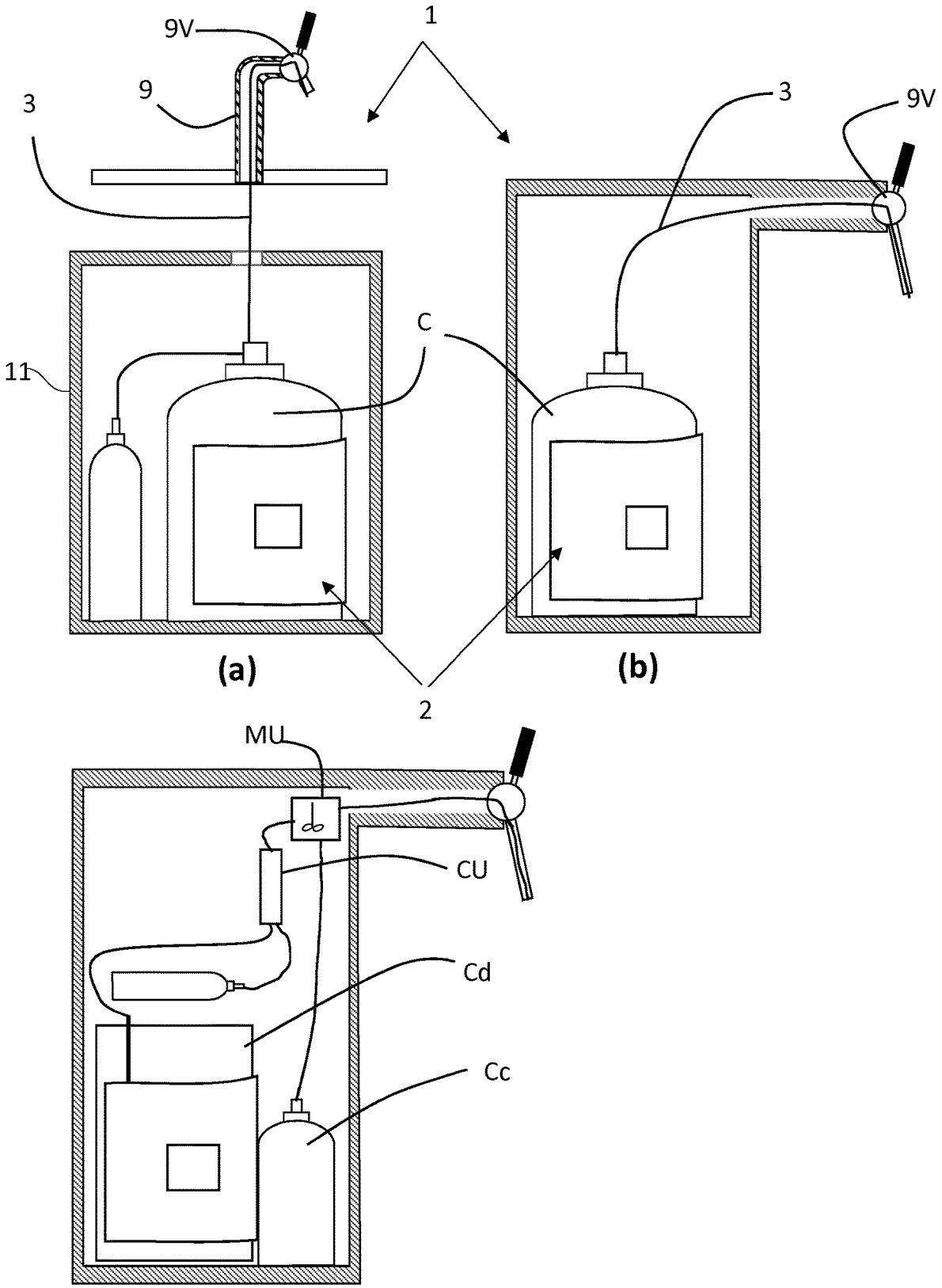
FIG. 2: shows different alternative embodiment of a dispensing apparatus according to the present invention (a) a dispensing apparatus of a type suited for use on-trade, (b) a dispensing apparatus of a type suited as domestic appliance, and (c) a dispensing apparatus of a type allowing dispensing a beverage starting from a beverage concentrate and a diluent.

As illustrated in FIG. 2*a*, the present invention concerns a beverage dispensing apparatus comprising the following elements:

- a beverage dispensing appliance (1) provided with a cooling unit (2) comprising a slot for receiving a beverage container (C);
- an dispensing tube (3) coupled to or suitable for coupling, on the one hand, to a container (or reservoir) containing a beverage or beverage component and, on the other hand, to the dispensing tap (9V), provided for example at the top of a dispensing column (9) as traditionally used in pubs.

The foregoing elements will be discussed in more details in continuation. The gist of the invention is that the cooling unit (2) comprises a heat conductive panel (2H) comprising two material layers fixed against one another (FIG. 1):

(i) a first material layer (2.1) defining a cooling surface (2.1*c*) facing the container receiving slot and an opposed surface (2.1*o*) said first layer made of a material having a thermal expansion coefficient of $X_1$;

(ii) a second material layer (2.2) having a contact surface (2.2*c*) facing positioned against the opposed surface (2.1*o*) of the first material layer and an opposed surface (2.2*o*), the second material layer having a thermal expansion coefficient of $X_2$, different from $X_1$, the difference in thermal expansion, causing the conductive panel to bulge at a change in temperature.

With fixed it is indicated that both layers are unified to make an integral body, such that upon bending of one of the layers, the other layer bends along.

Figure 1:
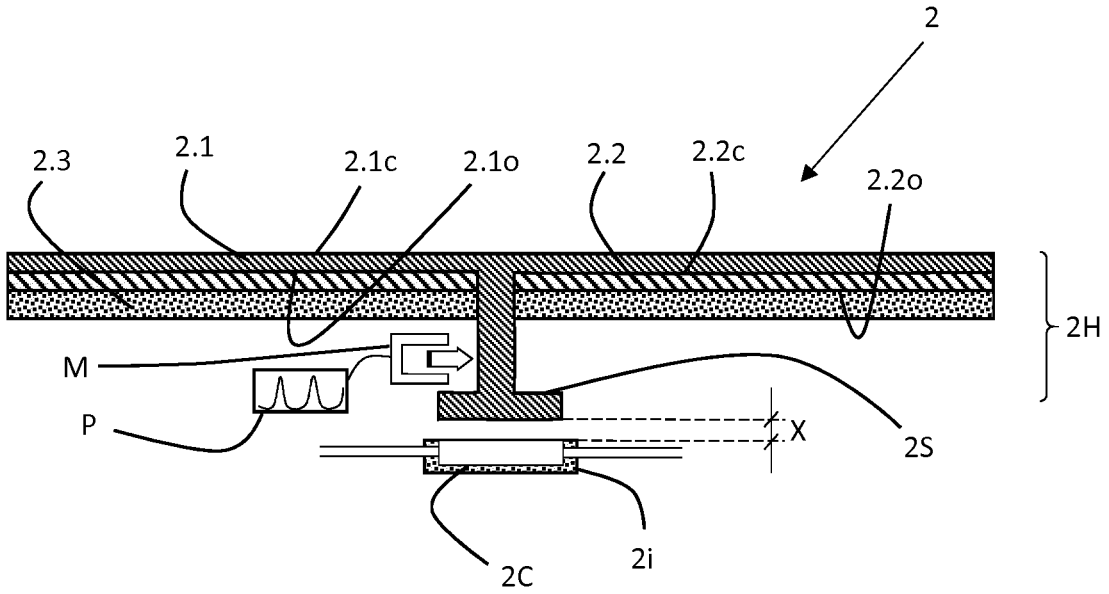
FIG. 1: shows a cooling unit according to the present invention in two different states.
Figure 1:
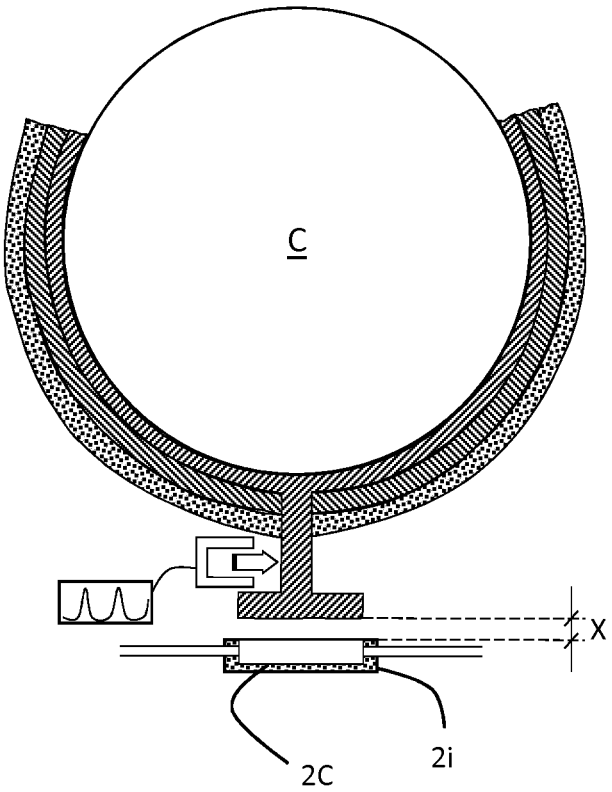

In the embodiment of FIG. 1, the heat conductive panel (2H) further comprises an insulation layer (2.3) fixed to the opposed surface of the second material layer.

The cooling unit comprises a cold source (2C) for cooling the conductive panel. Any type of cold source known in the art can be used. Typically compressor based refrigeration systems or thermoelectric cooling systems are well suited for cooling the conductive panel. Any other method can, however, be used without departing from the present invention. The cooling unit is preferably provided with insulation material (2*i*) arranged such as to enhance heat exchange only from the conductive panel surface facing the beverage container receiving slot.

This heat exchange is preferably obtained through a socket (2S) that is part of the heat conductive panel (SH), and connects the cold source with the first material layer of heat conductive panel in a in thermal conductive manner. The socket is preferably manufactured in one piece with the first layer (2.1) and protrudes through the second layer (2.2) of the heat conductive panel as depicted in FIG. 1.

It is preferred to orient the heat conductive panel such that the second material layer has a thermal expansion coefficient $X_2$ that is smaller than the thermal expansion coefficient $X_1$ of the first material layer that is connected to the cold supply. As such, the first layer contracts more than the second layer upon cooling of the conductive panel as a result of which the conductive panel bulges to form a concavity towards the beverage container positioned in the appointed slot. The result is a snugly fit of the conductive plate with the container, that preferably has an elliptical or cylindrical cross section, thereby increasing the effective contact area and allowing efficient cooling of the beverage contained in the container. The cooling unit according to the present invention is particularly convenient for containers of a type that do not have a very narrowly defined cross section, such as blow-moulded containers or larger (1.5 l or more) metallic containers, as the conductive panel adapts its cross section to the containers outer surface upon cooling.

Optionally, the distance X between the socket (2S) and the cold supply (2C) can be varied. Such variation effectively allows controlling the temperature of the heat conductive panel, especially when the heat conductive panel is manufactured from thin film layers having a very limited heat storage capacity. When a tight contact between the socket and the cold supply is established; the cold source will cool the heat conductive panel or maintain the heat conductive panel at a low temperature (eg. −2° C.). At this low temperature, the heat conductive panel is bulged and clamps a container (C) positioned in the slot. When the contact between the socket and the cold supply is broken, an air layer is formed between the socket and the heat conductive panel, thereby insulating the heat conductive panel from the cold source. Depending on the ambient temperature and eventually the temperature of a container in contact with the heat conductive panel, the heat conductive panel will start warming and bulging of the heat conductive panel will decrease, thereby decreasing the contact area between container and heat conductive panel, making that even when the container is cooled to a desired temperature of eg. 2° C., the heat conductive panel will start heating up by air present in the housing and bulging of the heat conductive panel will further decrease.

As the heat conductive panel is preferably dimensioned to enwrap the container over a section of more than 180° in cross section, cooling of the heat conductive panel (socket in contact with the cold supply) will allow effectively tightly clamping the container and as such, due to the good contact between the container and the heat conductive panel, effectively cool the container. When the contact between the cold supply and the socket is broken (distance X increases), the temperature of the heat conductive panel will increase (the container will always be slightly warmer than the cold supply) and bulging of the heat conductive panel will decrease, thereby decreasing the contact area between the heat conductive panel and the container such that even when the container is relatively cool, the heat conductive panel will warm up, eventually to a higher temperature than the container and the bulging of the heat conductive panel will decrease to a rate wherein the container can easily be removed from the slot.

Varying the distance between the socket of the heat conductive panel and the cold supply can be achieved by a regulator working on a large variety of principles well known in the art such as by means of one or more screws, a solenoid, a notch, etc. . . .

In a preferred embodiment, the cooling unit further comprises a pulse generator (P) with an output coupled to a motion producing means (M) for cyclically producing a mechanical motion of a beverage container provided in the slot. (Electronic) Pulse generators are known in the art for over thirty years and will not be discussed in further detail. The motion producing means can be any kind of device or unit that allows cyclically mechanically hitting the container or the heat conductive panel, thereby generating a motion (agitation) of the beverage stored in the container. Such agitation is believed to improve the cooling efficiency. Examples of motion producing means included solenoids, a revolving notch, etc. . . .

FIG. 2*b* illustrates a beverage dispensing apparatus according to the present invention comprising the following elements:

- a beverage dispensing appliance provided with a cooling unit (2) comprising a slot for receiving a beverage container;
- an dispensing tube (3) coupled to or suitable for coupling, on the one hand, to a container (or reservoir) containing a beverage or beverage component and, on the other hand, to the dispensing tap (9V), provided in a single housing with the cooling unit (2) and the container receiving slot.

Such embodiment of the beverage dispensing apparatus is particularly suited for use as a home appliance for dispensing a beverage.

FIG. 2*c* illustrates a cooling unit (2) as defined in the present invention in a dispensing apparatus suited for dispensing a beverage starting from a concentrated beverage component (Cc), such as a concentrated beer or cider, a diluent (Cd) and potentially, a source of compressed gas (Cg) (eg. carbon dioxide, nitrogen or a mixture of both). In such dispensing apparatus it is preferred that the cooling unit is positioned to cool a keg or reservoir (Cd) with diluent (eg. water or a neutral beer base). The cooled diluent from the keg or reservoir is fluidly connected to a carbonation unit (CU) as carbonation of the diluent can be performed more efficiently at sub room temperature. The carbonation unit is preferably positioned downstream a mixing unit (MU) wherein a concentrated beverage component is mixed with the pre-carbonated diluent. Alternatively or additionally, a cooling unit can be positioned to cool the container comprising a beverage concentrate, however, it is preferred to cool the diluent or final beverage as the diluent represents the largest volume fraction of the final beverage, especially in the case of beer.

Figure 3:
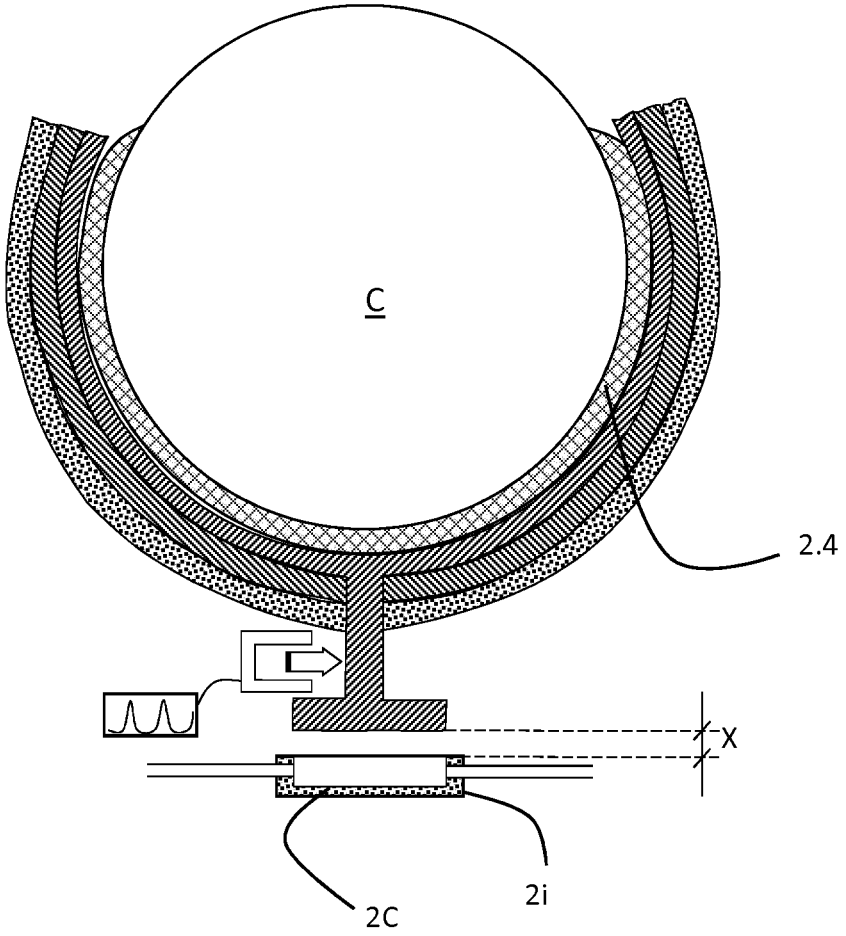
FIG. 3: shows an alternative embodiment of a cooling unit showed in FIG. 1(*b*).

FIG. 3 shows another embodiment of the cooling unit, wherein a flexible cold storage element (2.4) is provided on the conductive element on the side facing the container receiving slot. This flexible cold storage element, preferably concerns a pouch filled with a material having a high heat latency such as a phase change material. The cold storage element provides the advantages that:

(i) once cooled, the container can be maintained at a desired temperature without the need for constant cooling of the conductive element;

(ii) the flexible cold storage element can be pre-cooled before providing a beverage container in the receiving slot, to allow faster cooling of the container;

(iii) in case the cold storage element is flexible, a close fit between the pouch and the container can be obtained, even in case the container has an irregular surface.

The invention claimed is:

1. A beverage container cooling unit comprising:

(a) a housing comprising a slot for receiving a container therein;

(b) a cooling element comprising a cold supply;

(c) a heat conductive panel enabling heat transfer between the container provided in the slot and the cold supply;

wherein the heat conductive panel comprises two material layers fixed against one another:

(I) a first material layer defining a cooling surface facing the container receiving slot and an opposed surface, said first layer made of a material having a thermal expansion coefficient of $X_1$;

(ii) a second material layer having a contact surface facing the opposed surface of the first material layer and a second opposed surface, the second material layer having a thermal expansion coefficient of $X_2$, different from $X_1$, the difference in thermal expansion, causing the conductive panel to bulge at a change in temperature, wherein $X_1>X_2$, such that upon cooling the heat conductive panel bulges to define a concave shape facing the slot for receiving the container.

2. The beverage container cooling unit according to claim 1, wherein said first material layer, defining the cooling surface, is manufactured in a material having a thermal expansion coefficient $X_1$ of at least $8\times10^{-6}$ $K^{-1}$, preferably at least $10\times10^{-6}$ $K^{-1}$, or more, such as aluminium.

3. The beverage container cooling unit according to claim 1, wherein said second material layer is manufactured in a material having a thermal expansion coefficient $X_2$ of at most $6\times10^{-6}$ $K^{-1}$, preferably at most $4\times10^{-6}$ $K^{-1}$, or less, such as invar.

4. The beverage container cooling unit according to claim 1, the heat conductive panel comprising a socket in thermal conductive contact with the first material layer and enabled to contact the cold supply of the cooling element.

5. The beverage container cooling unit according to claim 4, comprising a regulator allowing varying the distance between the socket and the cold supply.

6. The beverage container cooling unit according to claim 1, comprising a pulse generator with an output coupled to a motion producing means for cyclically producing a mechanical motion of a beverage container provided in the slot.

7. A beverage dispensing apparatus comprising the cooling unit as according to claim 1.

8. The beverage dispensing apparatus according to claim 7, comprising a first container containing a concentrated beverage component and fluidly connected to a dispense tap by a first dispense line and a second container or reservoir containing a diluent and fluidly connected to the dispense tap by a second dispense line, the cooling unit integrated in the apparatus for cooling the concentrated beverage container and/or the container or reservoir containing the diluent.

9. The beverage dispensing apparatus according to claim 8, comprising a mixing unit having an inlet in fluid communication with the first and second dispense lines and an outlet in fluid communication with the dispense tap.

10. The beverage dispensing apparatus according to claim 9, comprising a carbonation unit, preferably an in-line carbonation unit, having an inlet in fluid communication with the second container or reservoir containing the diluent and an outlet in fluid communication with the dispense tap, the cooling unit integrated in the apparatus for cooling the diluent container.

11. The beverage dispensing apparatus according to claim 10 is a domestic apparatus suitable for dispensing a carbonated malt-based beverage.

12. The beverage dispensing apparatus according to claim 11 an on-trade apparatus suitable for dispensing a carbonated malt-based beverage.

13. The beverage dispensing apparatus according to claim 7, comprising a mixing unit having an inlet in fluid communication with the first and second dispense lines and an outlet in fluid communication with the dispense tap.

14. The beverage dispensing apparatus according to claim 7, comprising a carbonation unit, preferably an in-line carbonation unit, having an inlet in fluid communication with the second container or reservoir containing the diluent and an outlet in fluid communication with the dispense tap, the cooling unit integrated in the apparatus for cooling the diluent container.

15. The beverage dispensing apparatus according to claim 7 is a domestic apparatus suitable for dispensing a carbonated malt-based beverage.

16. The beverage dispensing apparatus according to claim 7 an on-trade apparatus suitable for dispensing a carbonated malt-based beverage.

* * * * *